US011732428B2

(12) United States Patent
Jeyanthi Rani

(10) Patent No.: US 11,732,428 B2
(45) Date of Patent: Aug. 22, 2023

(54) SYSTEM FOR CONSTRUCTION OF DOUBLE U AND SINGLE U STEEL CONCRETE COMPOSITE STRUCTURE FOR BRIDGES

(71) Applicants: Vellaisamy Thavamani Pandi, Chennai Tamil Nadu (IN); Thavamani Pandi Jeyanthi Rani, Chennai Tamil Nadu (IN)

(72) Inventor: Thavamani Pandi Jeyanthi Rani, Chennai Tamil Nadu (IN)

(73) Assignees: Vellaisamy Thavamani Pandi, Chennai Tamil Nadu (IN); Thavamani Pandi Jeyanthi Rani, Chennai Tamil Nadu (IN)

( * ) Notice: Subject to any disclaimer, the term of this patent is extended or adjusted under 35 U.S.C. 154(b) by 177 days.

(21) Appl. No.: 17/297,359

(22) PCT Filed: Feb. 20, 2019

(86) PCT No.: PCT/IN2019/000008
§ 371 (c)(1),
(2) Date: May 26, 2021

(87) PCT Pub. No.: WO2020/110132
PCT Pub. Date: Jun. 4, 2020

(65) Prior Publication Data

US 2022/0025591 A1 Jan. 27, 2022

(30) Foreign Application Priority Data

Nov. 30, 2018 (IN) ..... 201841045227

(51) Int. Cl.
*E01D 2/00* (2006.01)

(52) U.S. Cl.
CPC ..... *E01D 2/00* (2013.01)

(58) Field of Classification Search
CPC ..... E01D 2/00; E01D 2/02; E01D 2/04
See application file for complete search history.

(56) References Cited

U.S. PATENT DOCUMENTS 1,447,257 A * 3/1923 Lindenthal ..... E01D 2/04 14/74.5
3,930,451 A * 1/1976 Huebner ..... B61B 5/02 104/294

(Continued)

FOREIGN PATENT DOCUMENTS

CN 105019646 A 11/2015
JP 2001-214405 A 8/2001

(Continued)

OTHER PUBLICATIONS

International Search Report and Written Opinion, International Patent Application No. PCT/IN2019/000008, dated Aug. 5, 2019 (8 pages).

(Continued)

*Primary Examiner* — Abigail A Risic
(74) *Attorney, Agent, or Firm* — Hamre, Schumann, Mueller & Larson, P.C.

(57) ABSTRACT

A system for construction of double U and single U steel composite structure for bridges and methods thereof are disclosed. The system comprising: a base slab (1), a plurality of top and bottom U shaped beams (2, 8) made of I section, exterior top and bottom slabs (3, 9), a bottom deck slab (4), foot path (5) and kerb (6). In precast scheme U shaped bottom beams (2) are placed at about 2 m interval and exterior slab and bottom deck slab are casted. Top U beams are casted in inverted position. Base slab is provided and bottom U system is placed and top U system is provided over bottom U system forming a full frame vierendeel type composite as a self-straining unit. Earth filling compaction (Continued)

to be done. The approaches are made of single U section and being extended with I beam and RCC slab. Cast in situ scheme is done similar.

2 Claims, 6 Drawing Sheets

(56) References Cited

U.S. PATENT DOCUMENTS

| | | | | |
|---|---|---|---|---|
| 4,424,652 | A * | 1/1984 | Turner | E04C 3/02 52/204.2 |
| 5,634,308 | A * | 6/1997 | Doolan | E04B 5/29 52/327 |
| 10,704,215 | B2 * | 7/2020 | Thavamani Pandi | E04C 3/294 |
| 2004/0182027 | A1 * | 9/2004 | Bonacci | E04B 5/29 52/319 |
| 2006/0162102 | A1 * | 7/2006 | Nelson | E01D 2/02 14/77.1 |
| 2006/0265819 | A1 * | 11/2006 | Azizinamini | E01D 2/00 14/74.5 |
| 2009/0013482 | A1 * | 1/2009 | Kennedy | E01D 22/00 14/78 |
| 2010/0170050 | A1 * | 7/2010 | Inose | B23K 35/00 219/76.1 |
| 2013/0283721 | A1 * | 10/2013 | Ahn | E04B 1/24 52/649.6 |
| 2019/0153683 | A1 * | 5/2019 | Southworth | E01D 6/00 |
| 2019/0316305 | A1 * | 10/2019 | Thavamani Pandi | E01D 19/12 |
| 2022/0205193 | A1 * | 6/2022 | Said | C04B 28/08 |

FOREIGN PATENT DOCUMENTS

| | | | |
|---|---|---|---|
| KR | 100881921 | B1 | 2/2009 |
| KR | 101476290 | B1 | 12/2014 |
| KR | 101654657 | B1 | 9/2016 |

OTHER PUBLICATIONS

International Preliminary Report on Patentability, International Patent Application No. PCT/IN2019/00008, dated Dec. 4, 2020 (6 pages).

* cited by examiner

SYSTEM FOR CONSTRUCTION OF DOUBLE U AND SINGLE U STEEL CONCRETE COMPOSITE STRUCTURE FOR BRIDGES

FIELD OF THE INVENTION

The present invention relates to the field of bridge engineering in particular to steel concrete composite bridge for economical and fast track construction. More particularly, the present invention relates to the system for construction of composite double U-shaped reinforced girder bridge and U-shaped composite reinforced girder approach made of I section and methods thereof for use in railway, metro and highway bridges.

BACKGROUND OF THE INVENTION

In composite construction of Road bridges, the main girders are placed along traffic direction at spacing of around 2.5 m to cover the deck width. Each girder is designed to take live loads passing in that alignment. Construction depth plays an important role in the design of the bridge and cost of approach. The depth of construction (top of road level to bottom of girder) is 2 m to 3.5 m for spans of 24 m to 45 m. Half through steel girders are constructed and it can be adopted for shorter spans due to its lesser moment of inertia. Also, subways are constructed in situ needing longer duration of blocking traffic. In precast construction segments of boxes are constructed closer to existing road or precast segments for one road are transported to site. Longer and wider boxes are not made due to difficulty in taking over road/rail, whereas box shaped structure for single lane/two lane/twin boxes and precast segments for single lane road are provided in existing construction system. Boxes meant for longer spans are cast in situ and small boxes suitable for one road/rail are precast and being transported by road due to restriction in width and height in transport by road. The existing road is to be closed to public for long time. Twin boxes are cast in situ. Alternatively two boxes are kept side by side In multi girder system, the each girder is designed to take loads in that strip. The depth of construction (bottom of main girder to road level) is high. Weight of steel used is high. Bracing and diaphragm arrangements add to weight and increase construction time. The construction is to be done in situ. Trestle beams and multiple columns are needed to support the deck. Elaborate formworks are needed. The crossing needs to be closed interfering traffic, which is not suitable for fast track construction. Ladder deck system steel usage is less but depth of construction is more, which leads to increase in the approach cost. More area exposed makes it vulnerable for rain and weathering agents. Half through steel construction main girder steel property alone is used. More depth of girder and quantum of steel are required, which is adoptable for short spans. More area exposed makes it vulnerable for rain and weathering agents. PSC U girder is used only for single lane Railway bridges. The casting is done at site needing elaborate form work, which is constructed for short spans up to 18 m and also not suitable for multi lane Road/Railway bridges.

One of the prior art KR101654657, discloses a bridge construction method using the side beam and the slab segments. The through bridge comprises: the two or more side beams arranged at intervals in the transverse direction, wherein the bottom of an end is supported on the upper surface of both abutment units spaced from each other in the longitudinal direction forming a lower foundation; both end flanges directly supported on the upper surface of the side beam; and a U-shaped slab segment including a U-shaped floor board unit formed between the both end flanges, wherein the U-shaped floor board unit is in contact with the inner surface of the side beams adjacent to each other and supports the inner side of the both side beams in the transverse direction as the U-shaped floor board unit is in contact with the both end flanges directly supported on the upper surface of the side beam. The drawbacks of the above invention: slab spans between main girders which are supported over abutments and deck width is less, which is not suitable for multilane Road/Rail and longer spans. The existing traffic is obstructed due to abutments supporting main girders and elaborate formwork arrangement.

Another prior art KR101476290 discloses a steel composite PSC corrugated steel plate U girder comprising: a lower flange (10) comprising a concrete layer (12) and a number of PS steel materials (11) provided inside the concrete layer (12) in a longitudinal direction; a pair of composite parts (20) connected respectively to both sides of the lower flange (10) such that the pair of composite parts are provided at an upper distance larger than a lower distance in distance between composite parts; and a pair of upper flanges (30) formed from concrete and connected respectively to upper sides of the pair of composite parts (20), in which the composite parts (20) comprises corrugated steel plates (24), lower coupling members (22) configured to couple lower portions of the corrugated steel plates (24) to the concrete (12) of the lower flange (10), and upper coupling members (26) configured to couple upper portions of the corrugated steel plates (24) to the concretes of the upper flanges (30). The corrugated plates of the above invention form web independent pair of composite parts and which is not suitable for wider/multi-lane Road/Railway bridges.

Yet another prior art KR100881921 "Opening steel composite U girder construction method" discloses a trapezoidal shaped opening type steel girder with high strength concrete in upper flange positive moment region and negative moment region with partial pre stressing.

From the above description, it is understood that the previous construction methods were being observed, which is not suitable for multilane road/rail and traffic obstructed, and also the bridge need to be constructed in parts namely substream and foundation etc. Hence the construction of the pre-engineered bridge altogether with substream and foundation has to be made in factory and been transported to site and erected in minimum time. There is a need for a construction of composite Double U-shaped reinforced girder bridge and U-Shaped composite reinforced girder approach made of I section by a way of providing a steel beam and slab system which is made to U shape being placed one over the other forming double U shaped composite structure making it easy for transporting and handling and also providing a new force transfer system through U shaped steel girders and RCC slab with composite interaction thereof, whereas U shaped steel girders forming a full frame vierendeel type composite which is a self-straining unit, which results in substantial reduction of deflection and moments at center of span in main girder making it suitable for longer spans.

OBJECT OF THE INVENTION

Accordingly, the primary object of the present invention is to provide a double U and approach/single U shaped steel composite structure made of I section for construction of Road/Rail bridge.

1. The primary object of the present invention is to provide a beam and slab system, whereas steel beam is made in U shape and slab of 0.2 m thickness is provided on exterior of top and bottom U beams and over deck portion of bottom U for transfer of forces.
2. It is another object of the present invention is to provide top U beam and bottom U beam connected at junction by means of splices welded or connected with HSFC bolts, which forms a full frame vierendeel type composite as a self straining unit, thereby frame action of which results in substantial reduction of deflection and moments at center of span in main girder, making it suitable for longer span.
3. It is even another object of the present invention to construct a bridge of span up to 60 m width suitable for the number of lanes of road/rail. The work at site is minimum to the extent of earthwork, placing the girders, filling sides with earth duly compacted, water proofing and drainage arrangements.
4. It is yet another object of the present invention to provide a beam and slab system which is much lighter compared to solid slab system, whereas the depth of construction is around a M up to 30 m and up to 2 m for span up to 60 m. For span above 30 m, U has to be made in 2 parts i.e 2 L with mid joint.
5. It is further object of the present invention to provide beam and slab system which is thin and less weight in structure which results in ease of transportation by road/rail and fast track construction.
6. It is another object of the present invention to provide entire bridge which is made in factories and sent to site resulting in better quality of work, whereas the interference to existing crossing arrangement is minimum during launching only.
7. It is even object of the present invention to reduce bridge and approach cost and to help in fast track construction and thus reduces cost and time overrun.
8. It is yet another object of the present invention to increase vertical clearance for road or rail inside the subway apart from overall saving in bridge cost, for railway and metro bridges and highway bridges.

SUMMARY OF THE INVENTION

It will be understood that this disclosure is not limited to the particular systems, and methodologies described, as there can be multiple possible embodiments of the present disclosure which are not expressly illustrated in the present disclosure. It is also to be understood that the terminology used in the description is for the purpose of describing the particular versions or embodiments only, and is not intended to limit the scope of the present disclosure.

According to the basic aspect of the present invention, there is provided a system for construction of double U and single U shaped steel composite structure made of I section for use in bridge including railway bridge and highway bridge, comprising: a plurality of base slabs and a plurality of bottom deck slab, wherein said bottom hollow portion between said exterior slabs and said bottom deck slabs is filled with lean concrete mix. A plurality of U shaped steel girders or beams formed of steel, including top U shaped steel girders and bottom U shaped steel girders made of I section is provided. The top U shaped steel girder or beams and said bottom U shaped steel girders or beams are placed one over another at an uniform interval of about 2 m. Top U shaped beam or steel girder (8) and said bottom U shaped beam or steel girder (2) being connected by splices welded or connected with HSFC bolts, which forms a full frame vierendeel type composite as a self straining unit, thereby frame action of which results in substantial reduction of deflection and moments at center of span in main girder, making it suitable for longer span.

Moreover, a plurality of approaches are made of single U section and being extended with I beam and RCC slab. A camber is provided inside the box by adjusting a web of bottom U shaped steel girder in a carriage way which is used up to four lanes for highway road and up to three lanes for railway/metro track. Furthermore, a slab of 0.2 m thickness is provided on exterior of top and bottom U shaped steel girders and on interior of bottom U shaped steel girder for transfer of forces.

According to an another aspect of the present invention, there is provided a precast method for construction of double U and single U shaped steel composite structure for use in bridge, comprising the steps of: providing a base slab and forming U shaped beams or girders made of I section by a way of cutting web plates of steel to thereby lifting camber for road drainage and also pre camber to thereby lifting dead load and up to 50% of live load, wherein flange plates are bent in corner to 5T (whereas T is the thickness of plate) to avoid residual stresses and being welded to web plate to form U shaped beams. The steel is galvanized to prevent corrosion. Placing U beams with shear connectors in contact with concrete about 2 m spacing. Spreading 6 mm thick Mild steel sheets over U beams welded with 3 mm welds. Concreting is done in exterior of beams and bottom deck.

Similarly top U beams are made in similar manner in inverted position. The Composite U system is transported by road/rail to site. Base slabs are precasted with lifting points at 3 m intervals. The composite U system and base slabs are transported by road/rail to site. For spans above 30 m up to 60 m, U is made up of two parts i.e 2 L with mid joints on account of transporting requirements.

Furthermore, said base slabs are lifted and base slabs are placed with lifting beam having lifting points of about 3 m. The bottom U shaped beam is placed in a position, over which top U shaped beam is placed and connected with splices welded or connected with HSFC bolts thereto, which forms a full frame vierendeel type composite as a self straining unit, thereby frame action of which results in substantial reduction of deflection and moments at center of span in main girder, making it suitable for longer span. The wearing coats with reinforcements are provided in both decks portions. The gap between exterior slab of bottom U shaped beams & deck slab of bottom U shaped beams is filled with lean concrete mix. The earth filling is to be done till the formation of top deck duly compacted and the bridge is being commissioned. The approaches in cutting process are provided by a way of making bottom U shaped beam which is further extended with I beams and RCC slab. The approaches in bank are provided by a way of making bottom U shaped beam which is further extended with I beams and RCC slab but except with the provision of slabs over inner side of U beams to thereby carrying road/rail loads and earth loads and exterior slabs up to GL. Finally, the joints are filled with epoxy/polymer modified mortar for water proofing.

Yet even another aspect of the present invention, there is provided an in situ method for construction of double U and single U shaped steel composite structure for use in bridge, comprising the steps of: earth work to the required level, sand filling and levelling course instead of base slab. Forming U beams and concreting exterior slabs is same as discussed in precast scheme. Lean concrete is to be filled up to top level of U beams. RCC deck slab is to be casted including foot path/raised kerb. Further steps for construction of top beams till commissioning is same as discussed in precast scheme.

BRIEF DESCRIPTION OF THE ACCOMPANYING DRAWINGS

The above set forth and other features of the invention are made more apparent in the ensuring detailed description of the invention, when read in conjunction with the accompanying drawings, wherein.

DETAILED DESCRIPTION OF INVENTION WITH REFERENCE TO THE ACCOMPANYING DRAWINGS

The preferred embodiment of the present invention will now be explained with reference to the accompanying drawings. It should be understood however that the disclosed embodiments are merely exemplary of the invention, which may be embodied in various forms. The following description and drawings are not to be construed as limiting the invention and numerous specific details are described to provide a thorough understanding of the present invention, as the basis for the claims and as a basis for teaching one skilled in the art how to make and/or use the invention. However in certain instances, well-known or conventional details are not described in order not to unnecessary obscure the present invention in detail.

Figure 1:
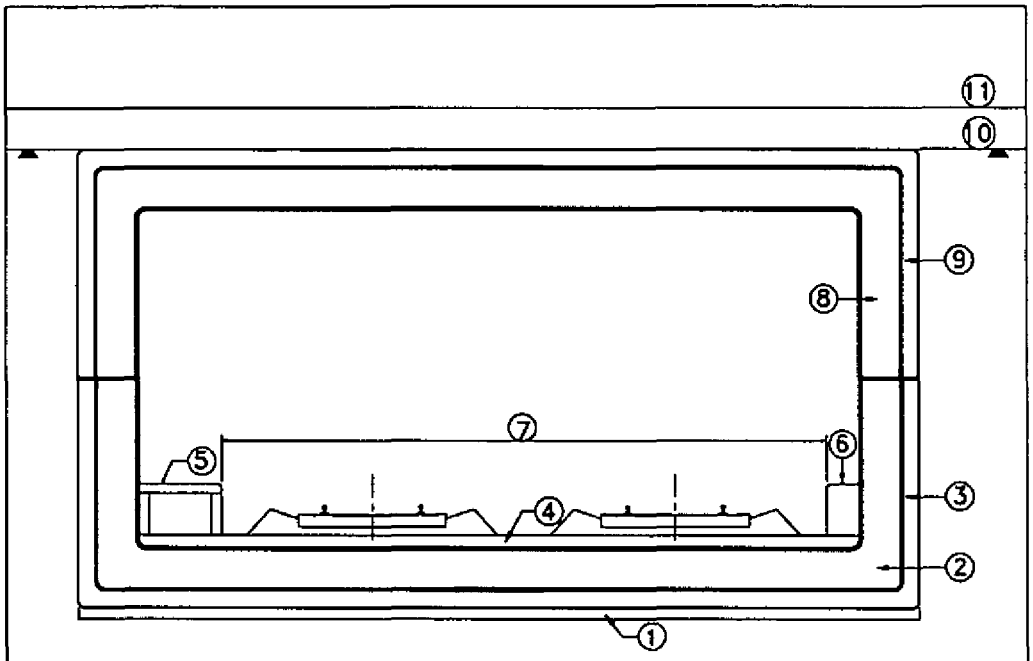
FIG. 1, illustrates the schematic representation of system for construction of composite double U shaped steel concrete girder bridge deck implemented in a rail bridge with railway tracks inside the box, railway track/highway above box according to the present invention.
Figure 2:
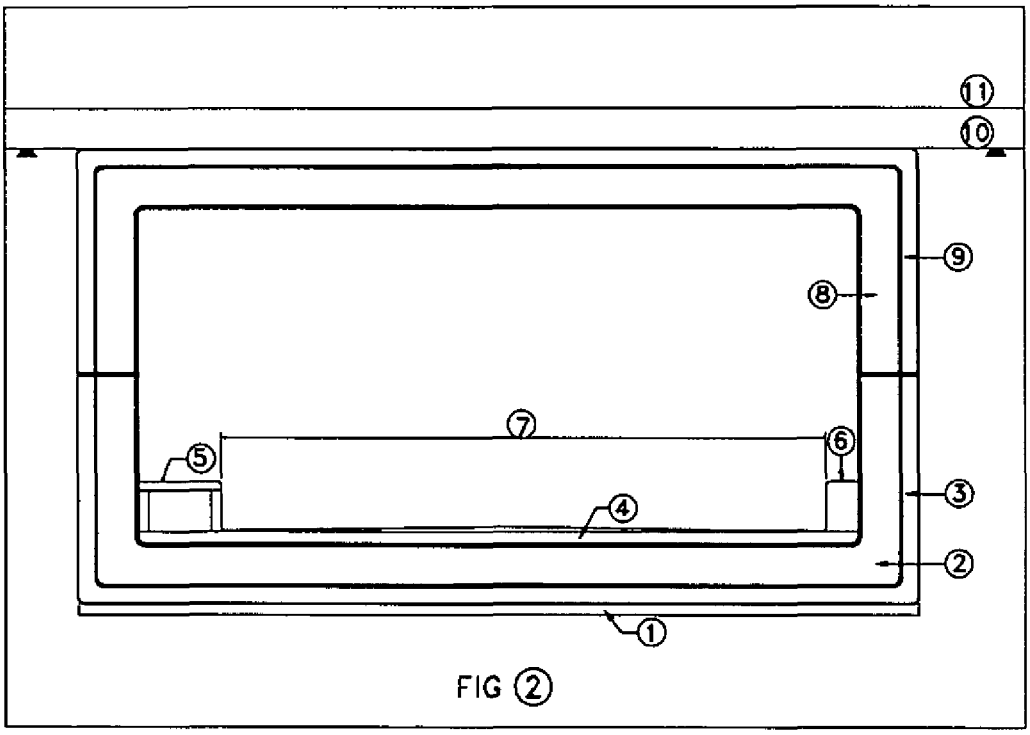
FIG. 2, illustrates the schematic representation of system for construction of composite double U shaped reinforced concrete and steel girders bridge deck implemented in a road bridge with a Highway inside the box, railway/highway above box according to the present invention.

With reference to the FIGS. 1&2, the invention is illustrated as applied to, the schematic representation of system for construction of composite double U shaped steel concrete girder bridge deck, implemented in a rail bridge with railway tracks inside box as shown in FIG. 1 and also implemented in a road bridge with highway inside box as shown in FIG. 2, comprising a plurality of base slabs (I), a plurality of top U shaped beams or girders (8) made of I section, a plurality of bottom U shaped beams or girders (2) made of I section, exterior bottom slabs (3) and bottom deck slabs (4), foot path (5), raised kerb (6), formation of rail tracks/highway (7), exterior top slab (9), road level (10) and rail level (11). The top and bottom U beams are placed one over another at an uniform interval of about 2 m. The top and bottom U beams (2,8) are connected by means splices welded or connected with HSFC bolts, which form a full frame vierendeel type composite as a self straining unit, thereby frame action of which results in substantial reduction of deflection and moments at center or span in main girder, making it suitable for longer span. The bottom hollow portion between said exterior bottom slabs (3) and said bottom deck slabs (4) is filled with lean concrete mix.

In one embodiment of the present invention, a camber is provided inside the box by varying a web of bottom U shaped beams in a carriage way which is used up to four lanes for Highway and up to three lanes for Railway/Metro track. A slab of 0.2 m thickness is placed over exterior portion of top U shaped steel girder (8) and bottom U shaped steel girder (2) and on interior portion of bottom U shaped steel girder (2) for transfer of forces. By a way of providing a new force transfer system with composite interaction of U shaped steel girder and slab system results in substantial reduction of deflection and moments at centre of span and adoptable for longer span.

In another embodiment of the present invention, there is provided a precast method for construction of double U and single U shaped steel composite structure for use in bridge, comprising the steps of: providing base slab and forming U shaped beams or girders made of I section by a way of cutting web plates of steel to thereby lifting camber for road drainage and also pre camber to thereby lifting dead load and up to 50% of live load, wherein flange plates are bent in corner to 5T (whereas T is the thickness of plate) to avoid residual stresses and being welded to web plate to form U shaped beams. The steel is galvanized to prevent corrosion. Placing U beams with shear connectors in contact with concrete about 2 m spacing. Spreading 6 mm thick Mild steel sheets over U beams welded with 3 mm welds. Concreting is done in exterior of beams and bottom deck.

Similarly top U beams are made in similar manner in inverted position. The Composite U system is transported by road/rail to site. Base slabs are precasted with lifting points at 3 m intervals. The composite U system and base slabs are transported by road/rail to site.

Furthermore, said base slabs are lifted and base slabs are placed with lifting beam having lifting points of about 3 m. The bottom U shaped beam is placed in a position, over which top U shaped beam is placed and connected with splices welded or connected with HSFC bolts thereto, which forms a full frame vierendeel type composite as a self straining unit, thereby frame action of which results in substantial reduction of deflection and moments at center of span in main girder, making it suitable for longer span. The wearing coats with reinforcements are provided in both decks portions. The gap between exterior slab of bottom U shaped beams & deck slab of bottom U shaped beams is filled with lean concrete mix. The earth filling is to be done till the formation of top deck duly compacted. Railway tracks/road way provided above box and the bridge is being commissioned. The approaches in cutting process are provided by a way of making bottom U shaped beam which is further extended with I beams and RCC slab. The approaches in bank are provided by a way of making bottom U shaped beam which is further extended with I beams and RCC slab but except with the provision of slabs over inner side of U beams to thereby carrying road/rail loads and earth loads and exterior slabs up to GL. Finally, the joints are filled with epoxy/polymer modified mortar for water proofing. Railway tracks/road way is provided above box.

In yet even another embodiment of the present invention, there is provided an in situ method for construction of double U and single U shaped steel composite structure for use in bridge, comprising the steps of: earth work to the required level, sand filling and levelling course instead of base slab. Forming U beams and concreting exterior slabs is same as discussed in precast scheme. Lean concrete is to be filled up to top level of U beams. RCC deck slab is to be casted including foot path/raised kerb. Further steps for construction of top beams till commissioning is same as discussed in precast scheme except that work is done at site.

Figure 3:
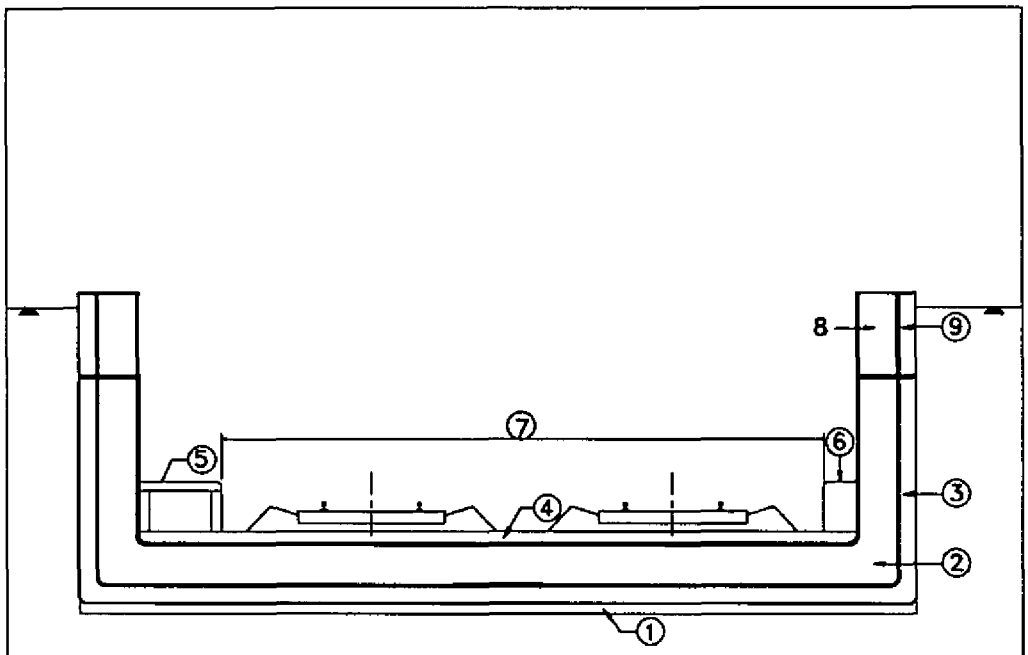
FIG. 3, illustrates the schematic representation of system for composite U shaped steel concrete girder implemented in a rail cuttings with railway tracks inside U, according to the present invention.
Figure 4:
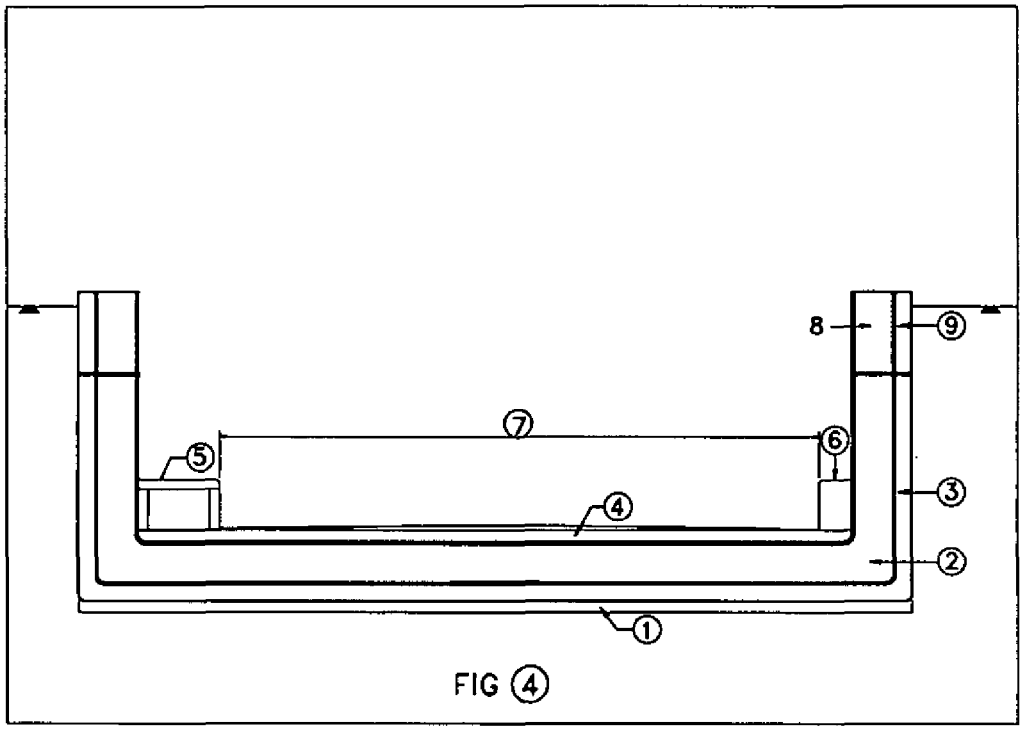
FIG. 4, illustrates the schematic representation of system for composite U shaped steel concrete girder implemented in a road cuttings with highways inside U, according to the present invention.

With reference to the FIGS. 3&4, the invention is illustrated as applied to, the schematic representation of system for construction of composite U shaped steel concrete girder implemented in a rail cuttings with railway tracks inside box as shown in FIG. 3 and also implemented in a road cuttings with highway inside box as shown in FIG. 4, comprising plurality of base slabs (I), a plurality of top U shaped beams or girders (8) made of I section, a plurality of bottom U shaped beams or girders (2) made of I section, exterior bottom slabs (3) and bottom deck slabs (4), foot path (5), raised kerb (6), formation of rail tracks/highway (7), I beam (12) and exterior wall (13). The spacing of U beams are around 2 m and are connected at top with tie beams. A plurality of approaches are made of single U section and being extended with I beam (12) and RCC slab. Moreover, a camber is provided inside the box by varying web of bottom beams in a carriage way which is used up to three lanes for Highway and up to two lanes for Railway/Metro track.

Figure 5:
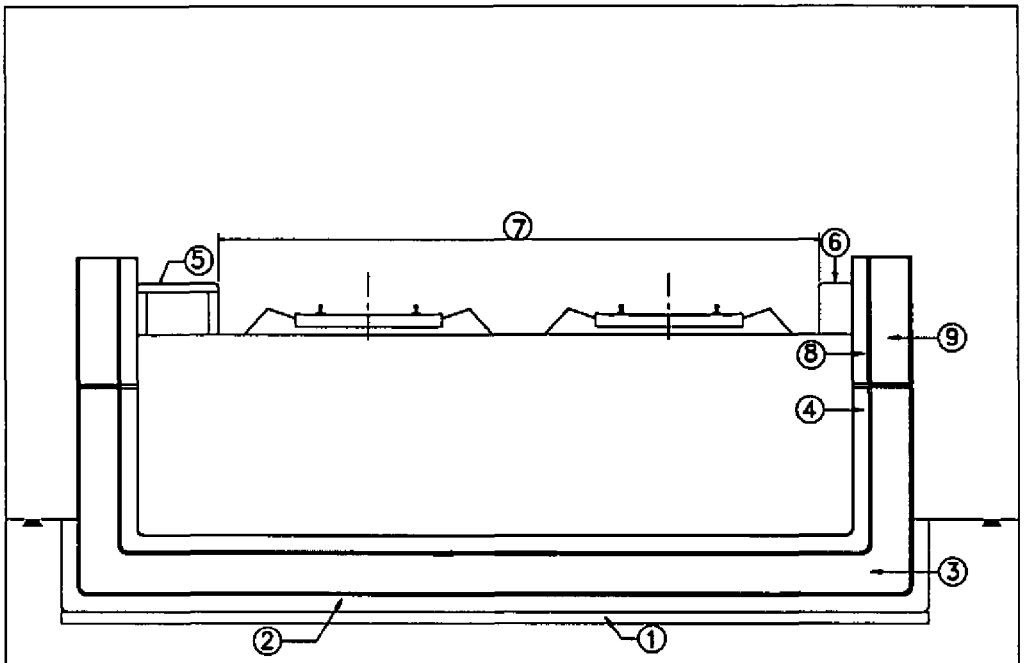
FIG. 5, illustrates the schematic representation of system for composite U shaped steel concrete girder implemented in a rail bank with railway tracks, according to the present invention.
Figure 6:
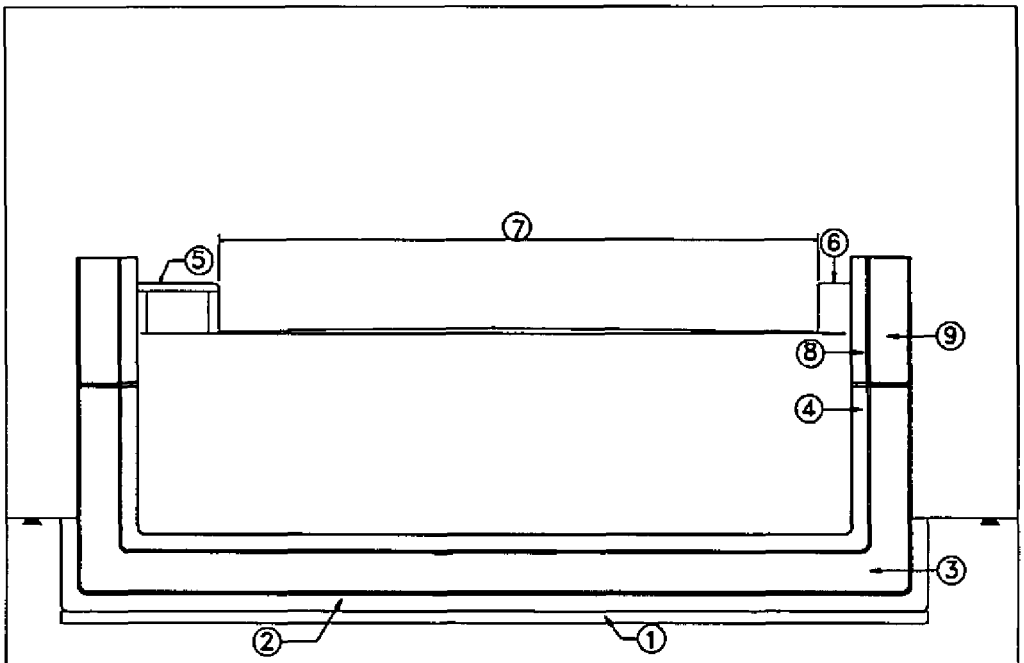
FIG. 6, illustrates the schematic representation of system for composite U shaped steel concrete girder implemented in a road bank with highways, according to the present invention.

With reference to the FIGS. 5&6, the invention is illustrated as applied to, the schematic representation of system for construction of composite U shaped steel concrete girder implemented in a rail bank with railway tracks as shown in FIG. 5 and implemented in a road bank with highway inside box as shown in FIG. 6, comprising plurality of base slabs (1), a plurality of top U shaped beams or girders (8), a plurality of bottom U shaped beams or girders (2), exterior, wall cum bottom slabs (3) and bottom deck slabs (4), foot path (5), raised kerb (6), formation of rail tracks/highway (7), I beam (12) and interior wall (14). The spacing of U beams are around 2 m and are connected at top with tie beams. A plurality of approaches are made of single U section and being extended with I beam (12) and RCC slab. By a way of providing a new force transfer system with composite interaction of U shaped Steel girder and slab system results in substantial reduction of deflection and moments at centre of span and adoptable for longer span.

Although the present invention has focused mainly on applications in railway, road and metro bridges, the invention is not limited to any particular bridges, but also applicable in road rail crossings, road/road, road/metro crossings, rail/rails crossings, river bridges for road/rail water ways known to those skilled in the art.

Advantages of the Present Invention

1. The present invention ensures that Double U/Single U shaped steel beam and slab system which is light in weight.
2. The entire bridge can be pre manufactured in factories in the form of segments which can be transported by road/rail.
3. Bridge of span up to 60 m width suitable for the number of lanes of road/rail can be constructed. The work at site is minimum to the extent of earthwork by placing the girders filling sides with earth and compaction and water proofing.
4. Beam and slab system is much lighter compared to solid slab system, whereas the depth of construction is around a M up to 30 m and up to 2 m for span up to 60 m. For span above 30 m, U has to be made in 2 parts i.e 2 L with mid joint. Thinner and less weight structure results in ease of transportation by road/rail and fast track construction. It reduces bridge and approach cost and helps fast track construction and thus reduces cost and time overrun.
5. The entire bridge can be made in factories and sent to site resulting in better quality of work. The interference to existing crossing arrangement is minimum during launching only.
6. For Railway and Metro bridges and highway bridges, it increases vertical clearance for road or rail inside the subway apart from overall saving in bridge cost.

It is emphasized that the Abstract of the Disclosure is provided to allow a reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment. In the appended claims, the terms "including" and "in which" are used as the plain-English equivalents of the respective terms "comprising" and "wherein," respectively. Moreover, the terms "first," "second," "third," and so forth, are used merely as labels, and are not intended to impose numerical requirements on their objects.

Without further description, it is believed that one of ordinary skill in the art can, using the preceding description and the illustrative examples, make and utilize the present invention and practice the claimed methods. It should be understood that the foregoing discussion and examples merely present a detailed description of certain preferred embodiments. It will be apparent to those of ordinary skill in the art that various modifications and equivalents can be made without departing from the spirit and scope of the invention.

The invention claimed is:

1. A U shaped steel concrete composite structure for bridges, comprising:

U shaped steel beams which are I sections made of web plates and flange plates;

wherein, said web plates are formed to provide camber for road drainage and pre-camber for lifting dead load and live load up to 50%, and wherein the said flange plates are bent in the corners up to five times the thickness of said flange plates to avoid residual stresses; the said web plates and said flange plates are welded, so as to form said U shaped steel beams which are connected thereto;

RCC slabs, wherein said RCC slabs are coupled with said U shaped steel beams by means of shear connectors to form composite frame action in said composite U shaped steel concrete composite structure for bridges.

2. A method of forming U shaped steel concrete composite structure for bridges comprising:

forming of U shaped steel beams of I section, which further comprising the steps of:

forming web plates in a manner to provide camber for road drainage and pre-camber thereby lifting dead load and live load up to 50%;

bending the flange plates in corner up to five times the thickness of said flange plates to avoid residual stresses and welding the said flange plates with said web plates so as to form U shaped steel beams, wherein shear connectors are provided to connect U shaped steel beams with concrete; and connecting said U shaped steel beams and concreting on the exterior and interior deck of U shaped steel beams, thereby forming U shaped steel concrete composite structure for construction of bridges.

* * * * *